US006244688B1

(12) United States Patent
Hickman

(10) Patent No.: US 6,244,688 B1
(45) Date of Patent: Jun. 12, 2001

(54) PEN STAGGER IN COLOR INKJET HARD COPY APPARATUS

(75) Inventor: Mark S. Hickman, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/357,686

(22) Filed: Jul. 20, 1999

(51) Int. Cl.[7] ..... B41J 2/21
(52) U.S. Cl. ..... 347/43; 347/15; 347/40
(58) Field of Search ..... 347/43, 40, 47, 347/12, 15, 41, 42

(56) References Cited

U.S. PATENT DOCUMENTS

| | | | |
|---|---|---|---|
| 4,540,996 | 9/1985 | Saito | 347/43 |
| 4,709,246 | 11/1987 | Piatt et al. | 347/40 |
| 4,709,247 | 11/1987 | Piatt et al. | 347/40 |
| 4,833,491 | 5/1989 | Rezanka | 347/43 |
| 4,940,998 | 7/1990 | Asakawa | 347/37 |
| 5,241,325 | 8/1993 | Nguyen | 347/49 |
| 5,376,958 | 12/1994 | Richtsmeier et al. | 347/40 |
| 5,428,375 * | 6/1995 | Simon et al. | 347/12 |
| 5,488,397 | 1/1996 | Nguyen et al. | 347/40 |
| 5,635,969 | 6/1997 | Allen | 347/96 |
| 5,742,306 | 4/1998 | Gompertz et al. | 347/43 |
| 5,754,198 * | 5/1998 | Nishikawa | 347/43 |
| 5,861,899 | 1/1999 | Nguyen et al. | 347/40 |

FOREIGN PATENT DOCUMENTS

| | | | |
|---|---|---|---|
| 402047075 * | 2/1990 | (JP) | 347/43 |
| 403208666 * | 2/1990 | (JP) | 347/43 |

OTHER PUBLICATIONS

The Hardcopy Observer, Apr. 1999, Seybold Boston 1999, "ColorSpan's Display Maker Series XII Offers Twelve Colors".

* cited by examiner

*Primary Examiner*—N. Le
*Assistant Examiner*—Lamson D. Nguyen

(57) ABSTRACT

A multi-swath, ink-jet pen carriage and pen arrangement provides optimization for redundant colorant pens. Packing of electrical and fluidic interconnects enables an increased printing throughput with increased color combinations in an apparatus that minimizes product size for a given number of pens in the apparatus.

25 Claims, 7 Drawing Sheets

PEN STAGGER IN COLOR INKJET HARD COPY APPARATUS

BACKGROUND OF THE INVENTION

1. Field of the Invention

The present invention relates generally to ink-jet hard copy printing and, more particularly to devices and techniques for improving the print quality of multiple pen, or ink cartridge, color ink-jet hard copy apparatus.

2. Description of Related Art

The art of ink-jet technology is relatively well developed. Commercial products such as computer printers, graphics plotters, copiers, and facsimile machines employ ink-jet technology for producing hard copy. The basics of this technology are disclosed, for example, in various articles in the *Hewlett-Packard Journal*, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994) editions. Ink-jet devices are also described by W. J. Lloyd and H. T. Taub in *Output Hardcopy* [*sic*] *Devices*, chapter 13 (Ed. R. C. Durbeck and S. Sherr, Academic Press, San Diego, 1988). For convenience of description, hard copy apparatus of all shapes, sizes, and varieties are referred to hereinafter simply as a "printer."

FIG. 1 (PRIOR ART) depicts an ink-jet, computer peripheral printer 101. A housing 103 encloses the electrical and mechanical operating mechanisms of the printer 101 (with its housing shell removed). Operation is administrated by an electronic controller 102, usually a microprocessor or printed circuit board connected by appropriate cabling to a computer (not shown). It is well known to program and execute imaging, printing, print media handling, control functions and logic with firmware or software instructions for conventional or general purpose microprocessors or with ASIC's. Cut-sheet print media 105, loaded by the end-user onto an input tray 120, is fed by a suitable paper-path transport mechanism (not shown) to an internal printing station, or printing zone, 107 where graphical images or alphanumeric text is created. A carriage 109, mounted on a slider 111, scans the print medium. An encoder 113 is provided for keeping track of the position of the carriage 109 at any given time. At least one, or a set, of individual ink-jet pens, or print cartridges, $\mathbf{115}_x$ (where x=an ink-type specification) are releasable mounted in the carriage 109 for easy access. Generally, in a full color system, inks for the subtractive primary colors—cyan, yellow, magenta (CYM) and true black (K) (F standing for a fixer fluid sometimes used to enhance ink drying time (see e.g., U.S. Pat. No. 5,635,969 by Allen for a METHOD AND APPARATUS FOR THE APPLICATION OF MULTIPART INK-JET INK CHEMISTRY, assigned to the common assignee of the present invention and incorporated herein by reference))—are provided in remote, or "off-axis," replaceable or refillable, ink reservoirs $\mathbf{117}_x$ having fluidic couplings 119 to the pens $\mathbf{115}_x$. Once a printed page is completed, the print medium is ejected onto an output tray 121.

It is common in the art to refer to the pen scanning direction as the Cartesian x-axis, the paper feed direction as the y-axis, and the ink drop firing direction as the z-axis. For convenience of description, print media of all shapes, sizes, and varieties are referred to hereinafter simply as "paper." An image is formed by printing a pattern of individual dots at particular locations of an array defined for the sheet of paper positioned in the print zone 107. These locations are conveniently visualized as being in a rectilinear matrix and are referred to synonymously as picture elements, or "pixels," or "dot locations (or positions)" or "drop locations (or positions)." The printing operation is thus the filling in of pixels identified in a print data set with dots, or drops, of ink. Primary, or "base," colors are produced at a pixel by depositing one or more drops from a respective pen $\mathbf{115}_x$ and other hues are produced my depositing multiple drops of different base color inks onto the same pixel, the overprinting of two or more base colors producing secondary colors according to well-established optical principles.

Print quality is determined by dot-resolution and the precise placement of drops, particularly of over-printed drops which occur on separate scans of a swath of print to allow sufficient drying time of a first drop deposition prior to deposit of the overlying drop. As current commercial product resolution is about 300 dots per inch ("dpi"), and preferred resolution is more than 600 dpi, the problem of accurate drop placement places a constant demand for the designer also striving to meet the commercial demand for greater throughput (pages per minute, "ppm") and increased color rendition, particularly in photographic quality ink-jet printing.

One prior art technique to improve print quality by allowing longer dry time for first deposition ink drops is taught in U.S. Pat. No. 5,316,958, filed on May 1, 1992 by Richtsmeier, Doan and Hickman (common applicant herein) for STAGGERED PENS IN COLOR THERMAL INK-JET PRINTER (Richtsmeier et al.). A four pen system is shown which offsets different color printheads such that nozzle arrays traverse spaced apart non-overlapping print regions as the carriage is scanned along the carriage scan axis. This system allows longer first deposition drying time, but requires a full print cartridge width in the product. Simultaneous, multiple printhead use per color is not envisioned in this implementation.

Another prior art technique for printing multiple swaths is shown in U.S. patent application Ser. No. 09/233,575, filed Jan. 19, 1999 by common applicant herein Hickman, ENTITLED "DRUM-BASED PRINTER USING MULTIPLE PENS PER COLOR". Ink-jet pens are combined in a printer so that the swaths printed by individual pens are combined into a resultant, wide swath that increases printer throughput. The print medium is carried on a drum and advanced through the printer. Sets of two pens, each set having the same color of ink, are carried near the drum with the two pens arranged such that the swath of one pen is adjacent to the swath of the other pen in a direction that is parallel to the drum axis. Also provided is a carriage assembly for carrying the pens in the just mentioned arrangement for combining the swath widths of the individual pens. The components of the carriage assembly are such that two pens of the same color ink are precisely positioned relative to each other, thereby to meet a very close tolerance requirement for arranging two pens of the same color.

Another prior art technique is to simultaneously print multiple swaths is shown in assignee's co-pending patent application U.S. Ser. No. 09/311,919, filed by D. Pinkernell, ENTITLED "METHOD AND APPARATUS FOR MULTIPLEXED WET-DYE PRINTING", where redundant pen sets are mounted in the y-axis. This also allows simultaneous printing on multiple sheets of paper. Throughput is substantially increased.

There is still a need for ink-jet printer having increased throughput increased color combinations in an apparatus that minimizes product size for a given number of print cartridges in the apparatus.

SUMMARY OF THE INVENTION

In a basic aspects, the present invention provides an inkjet pen scanning carriage printing device for an ink-jet hard copy apparatus having a controller means for providing power and control signals Lo ink-jet writing instruments, the apparatus being defined by a scanning axis and a print media transport axis perpendicular to the scanning axis, the device including: a scanning carriage; and mounted in the carriage, at least two duplicate sets of pen means for firing ink drops onto adjacently positioned print media, the pen means each having a printhead ink drop firing nozzle array of a predetermined height, and each of the sets having at least three color inks such that duplicate pen means of each set form a color subset, and the pen means of each subset are offset linearly in the scanning axis and offset in the transport axis by approximately the nozzle array predetermined height, and each of the pen means having electrical interconnect means for providing power and control signals thereto wherein all electrical interconnect means are connected to the controller from a commonly aligned orientation position of the carriage.

In another basic aspect, the present invention provides a method of rendering ink-jet printing. The method includes the steps of: providing a carriage means for scanning ink-jet writing instruments across a print medium; mounting within the carriage means a plurality of writing instruments in a matrixed array, the array having multiple groups of writing instruments, each group having multiple writing instruments per color and each group having sets of pens offset in a scanning axis and a print medium advance axis such that each set has a pen of each color for the group, the array having each of the multiple groups of writing instrument offset in the print medium advance axis; scanning the carriage means across the print medium; and while scanning, producing swaths of print simultaneously from redundant color ink pens of the matrixed array such that a swath height capability for each color ink is equal to the sum of individual pen swath height capability for a single pen of the redundant color ink.

In another basic aspect, the present invention provides a printing unit for an ink-jet printer, including: "N" ink-jet writing instruments for firing ink drops onto adjacently positioned print media to form dot matrix patterns on the print media, where N is an integer; and carriage mechanisms for fixedly supporting the writing instruments in an array and for scanning the array across the print media in a scanning axis which is perpendicular to a print media transit axis, the array having at least two groups of writing instruments wherein each group has at least two sets of writing instruments and the groups are separated in the print media transit axis by a predetermined gap, wherein each set forms group-based subsets of matched color ink writing instruments such that each subset fires drops of at least one substantially identical ink of the set wherein writing instruments are positioned in the array such that each subset is mounted in the array linearly from a companion matched color ink writing instrument of the subset in the scanning axis and offset from a companion matched color ink writing instrument of the subset in the print media transit axis such that matched color ink writing instruments of a group are arranged to print a swath height of each the matched color equal to a multiple of an individual writing instrument printing swath height, wherein one scan across the media and tiring drops from matched color ink writing instruments results in a total swath height of a color equal to the sum of the swath heights of the individual writing instruments having the matched color ink.

Some of the advantage of the present invention are:

- it solves shortcomings of prior solutions;
- it increases the height of a printed swath while maintaining a carriage width and carriage scan distance equivalent to a system with fewer pens per color;
- it increase the height of a printed swath and hence printer throughput;
- it facilitates the implementation of electrical interconnects and fluidic couplings to remote ink reservoirs; and
- it allows for irregular spacing in the paper indexing direction between groups of differing color printheads.

The foregoing summary and list of advantages not intended by the inventor to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P. 608.01 (d) merely to apprize the public, and more especially those interested in the particular art to which the invention relates, of the nature of the invention in order to be of assistance in aiding ready understanding of the patent in future searches. Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically annotated.

DESCRIPTION OF THE PREFERRED EMBODIMENT

Reference is made now in detail to a specific embodiment of the present invention, which illustrates the best mode presently contemplated by the inventor for practicing the invention. Alternative embodiments are also briefly described as applicable.

Figure 2:
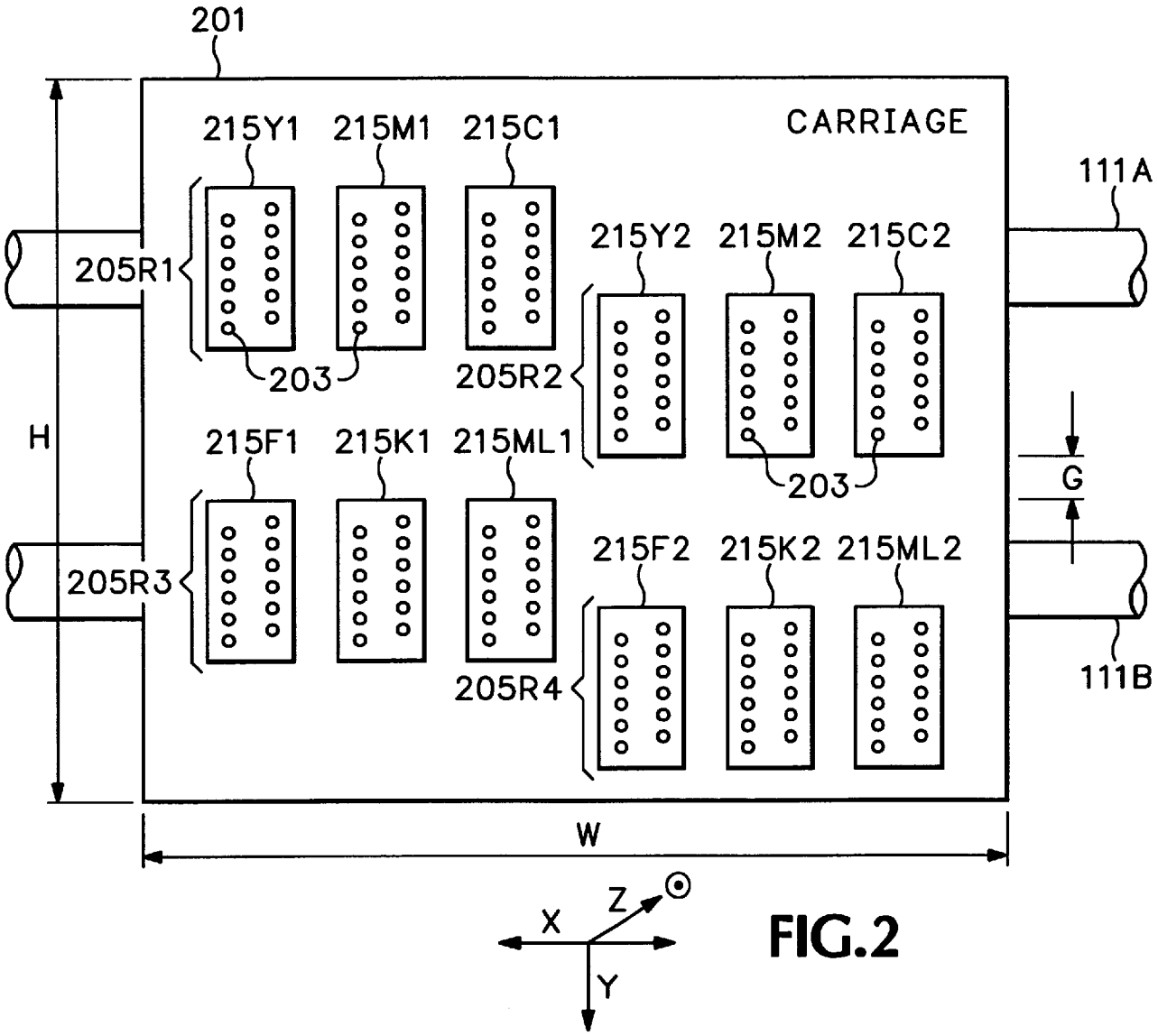
FIG. 2 is a schematic representation of the present invention.

FIG. 2 illustrates a scanning carriage, staggered pen arrangement in accordance with the present invention. [The term "pen" is used hereinafter generically for any ink-jet drop generating device, whether in the form of a reusable printhead module coupled to an off-axis ink reservoir, a self-contained, disposable print cartridge, thermal ink-jet device, piezoelectric ink-jet device, or other ink-jet writing instrument implementation as would be known in the art.] A pen carriage 201 is fabricated in accordance with known principles for mounting multiple ink-jet pens. It is known in the art that an ink-jet pen carriage has numerous, important features. See e.g., Richtsmeier et al. supra, U.S. Pat. No. 4,940,998 by Asakawa for a CARRIAGE FOR INK JET PRINTER; co-related U.S. Pat. Nos. 5,241,325, 5,488,397 and 5,861,899 by Nguyen et al., and U.S. Pat. No. 5,742,306 by Gompertz et al. for an IMAGING CARTRIDGE SYS- TEM FOR INKJET PRINTING MECHANISMS, each of which is assigned to the common assignee herein and incorporated herein by reference. Further discussion herein is not required for an understanding of the present invention. The carriage 201 is mounted on one or more slider bars 111A, 111B for traversing across the carriage scan distance in the x-axis.

In an array of pens mounted in the carriage 201, more than one pen of a given color ink formulation is provided. That is, sets of pens in predetermined position groups are provided to have subsets of matched color inks. In the exemplary embodiment of FIG. 2, using the subtractive primary colors: (1) a subset of two yellow ink pens 215Y1, 215Y2 of the two sets 205R1, 205R2, where "R" stands for "row," are separately mounted in the carriage 201, (2) a subset of two magenta ink pens 215M1, 215M2 are separately mounted in the carriage, and (3) a subset of two cyan ink pens 215C1, 215C2 are separately mounted as sets in the carriage. Each pair forming a subset 215Y1/215Y2, 215M1/215M2, 215C1/215C2 is staggered in the paper transit, y-axis. In other words, a first tri-color set 205R1 is mounted in a first row and a second tri-color pen set 205R2 is mounted in a y-axis displaced, second row of the carriage 201. The displacement in the y-axis is such that the nozzles 203 of each pen of a subset are contiguous or slightly overlapping for a swath printing operation. Each pair forming a subset 215Y1/215Y2, 215M1/215M2, 215C1/215C2 is offset linearly in the carriage scanning x-axis. Generally, the pens are packed as closely together side-by-side in the x-axis as permitted given mechanical tolerances of each pen and the carriage mounts provided for each based on alignment design factors well-known in the art.

Similarly, two more pen sets 205R3, 205R4, having matched color ink firing capability subsets, are mounted in a y-axis displaced, third and fourth row of the carriage 201. An arbitrary boundary gap, "G," separates the second row pen set 205R2 from the third row pen set 205R3 (see also, Pinkernell, supra, with respect to optimization of y-axis separation; further discussion here is not necessary to an understanding of the present invention). In this exemplary embodiment, one of the subsets is a pair of black ink pens 215K1, 215K2. The other two pens of each set can be implemented and matched in accordance with a specific design goal. For example, another one of the subsets can be used for pens 215F1, 215F2 to contain and fire droplets of an ink fixer fluid. In enhanced quality printing such as for photo-reproductions, a subtractive color having an altered pigment content is sometimes employed, e.g., a "magenta-light" ink, to improve color renditions. Thus, another one of the subsets in the third and fourth row sets 205R3, 205R4 can be a pair of magenta-light color ink pens 215ML1, 215ML2. Other groups of sets of pens as needed for a specific implementation can be designed; e.g., one group of yellow, cyan, and magenta ink sets and one group of red, blue, and green ink sets, and the like as would be recognized by a person skilled in the art.

The groups of pens, where in FIG. 2 "groups" are defined as "group A=205R1+205R2" and "group B=205R3+205R4" of pen sets, can employ any combination of inks as would be assigned based on the type of printing to be accomplished. The gap "G" between two groups of pen sets, can be arbitrary as long as no pen in separate groups uses the same ink unless complex nozzle firing algorithms are employed.

As is known in the state of the art, each pen has a printhead with at least one column and preferably two, y-axis oriented, offset, columns of nozzles 203 (see e.g., Richtsmeier et al., or HP Journals , supra ) from which the ink drops are fired in the z-axis onto adjacently positioned paper (not shown); only six nozzles per column are depicted, but it will be recognized by those skilled in the art that a column generally has as many nozzles as needed for producing a swath of pixels in accordance with the desired print resolution. In the arrangement in accordance with the present invention, each pair is mounted with an offset stagger in the y-axis such that the columns are aligned contiguously or aligned with a one or more nozzle overlap. Thus, for example if each yellow pen 215Y1, 215Y2 has a one inch high column of nozzles 203, a two inch high swath of yellow ink could be deposited by the top group 205R1, 205R2 across the width of the page being printed during a single scan across the page. It will be recognized by those skilled in the art that bi-directional print modes also can be employed with the present invention. Thus, with the redundant sets of pens having matched color inks and the simultaneous printing, a quadruple-height swath is printable with each scan of the carriage and its twelve pens and throughput is substantively increased.

Figure 3:
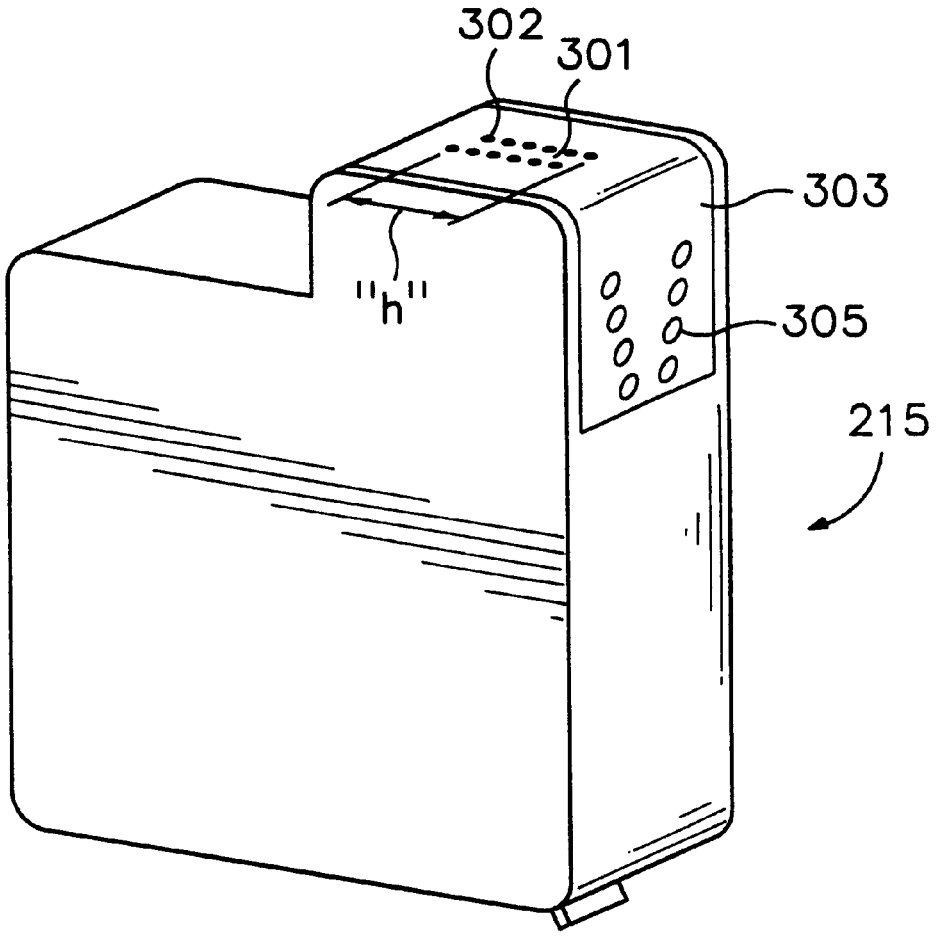
FIG.3 (PRIOR ART)
FIG. 3 (PRIOR ART) is an exemplary ink-jet pen as may be useful in accordance with the present invention as shown in FIG. 2.

Ink-jet pens require complex electrical input signal controls (and sometimes provide electrical feedback signals) controlled by a computer and driver software interacting with the application software to produce the hard copy. Turning to FIG. 2, in order to minimize carriage size, "H x "W," while providing full size pens $\mathbf{215}_{XN}$ (where "X" is a letter representing the color ink and "N" is a respective pen number of a set or subset of pens) and optimizing pen packing density, a common electric interface wall can be designed for the six pens of a group when the pens are mounted such that the electrical interconnect surfaces of the two groups are facing each other. A typical, commercially available pen 215 as used in the Hewlett-Packard DeskJet™ series of printers, is shown in FIG. 3 (PRIOR ART) having a printhead 301 with nozzles 302 and an electrical connector surface 303 having electrical interconnects 305. Thus, referring back to FIG. 2, by mounting the pens 215Y1, 215M1, 215C1 of the first row pen set 205R1 with their respective electrical connector surfaces facing the respective electrical connector surfaces of the pens 215F1, 215K1, 215ML1 of the third row set 205R3, a common electrical interface circuit board, or "wall" can be provided for all six pens. Similarly, a common electrical interconnect wall can be provided for the pens of the second row set 205R2 and the fourth row set 205R4. FIGS. 4A–4D depict alternative embodiments for such pen arrangements.

Figure 4A:
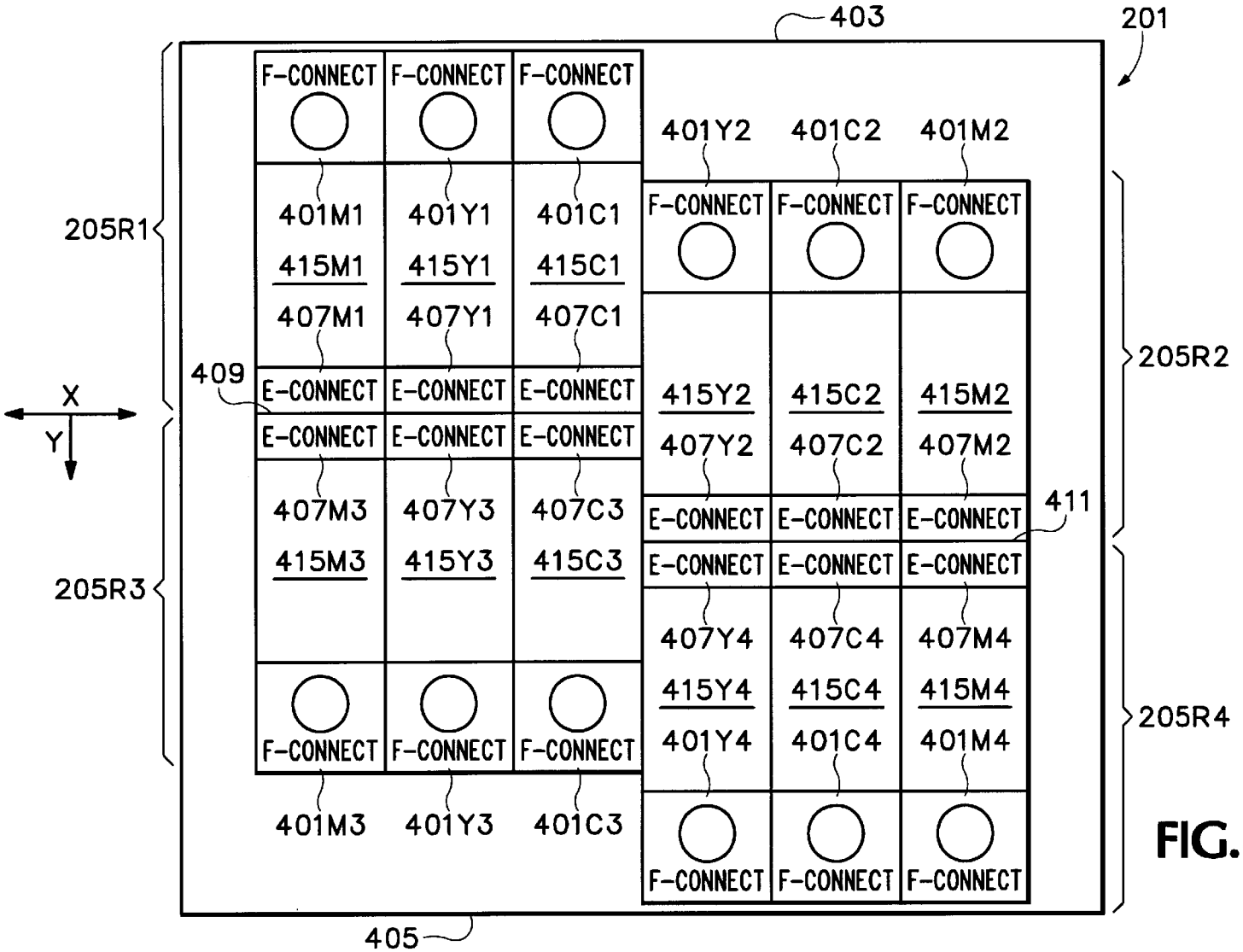
FIGS. 4A–4D are schematic representations of alternative embodiments of the present invention as shown in FIG. 2.

FIG. 4A shows a twelve pen layout similar to FIG. 2. In this exemplary embodiment fours pens for each of three colors of ink are provided (combining all three inks renders a composite black dot). The pens $\mathbf{415}_{XN}$ are mounted in carriage in a packing where the bottom group of pens 415M3, 415Y3, 415C3, 415Y4, 415C4, 415M4 are mounted in a mirror image configuration to the top group of pens 415M1, 415Y1, 415C1, 415Y2, 415C2, 415M2 of the array. In terms of ink-loading, this configuration avoids color order lay down reversal bands; viz., 415M1 is turned 180-degrees from 415M3, 415Y1 is turned and mounted 180-degrees from 415Y3, et. seq. in this manner, six fluid interconnections ("F-connect") 401M1, 401Y1, 401C1, 401Y2, 401C2, 401M2 are mounted linearly with a nozzle array height offset (not seen in this view) in the x-axis along a y-axis relative leading edge 403 of the carriage 201; six fluid interconnections 401M3, 401Y3, 401C3, 401Y4, 401C4, 401M4 are mounted likewise in the x-axis along a trailing edge 405 of the carriage 201. [A wide variety of fluid interconnects are known in the art and may be employed with the present invention; further explanation is not necessary to an understanding of the present invention.] Thus, with this arrangement, all fluid interconnects $401_{XN}$, are all attached at the periphery of the carriage 201, allowing a simpler bundling of ink feeder tubes 119 (FIG. 1 only) from off-axis ink reservoirs $117_X$. In a similar manner, each pen's corresponding electrical connector ("E-connect") 407M1, 407Y1, 407C1 of the leading group of pens is adjacent the electrical connectors 407M3, 407Y3, 407C3, 407 of the trailing group. [A wide variety of electrical interconnects are known in the art with flex-circuits being the most widely used; further explanation is not necessary to an understanding of the present invention.] Thus, a common connector wall 409, 411 can be provided between the respective leading and trailing groups of pens.

Note that in an alternate implementation of FIG. 4A which uses off-axis ink reservoirs (see FIG. 1, elements $117_X$) the fluid interconnect arrangement can also be implemented in the same manner as the electrical interconnect just described, providing a common fluidic interconnect "wall" between or adjacent alternate pen rows 205R1/205R3, 205R2/205R4 of alternate groups$_{A/B}$, respectively. All of the electrical connectors are then located commonly at the leading edge 403 and trailing edge 405, respectively, of the carriage 201.

Moreover, this carriage layout provides advantages in that the gap between the first and secong group of pens can be reduced to essentially zero, allowing for the same colors to be used in both groups. This results in a cumulative swath height of four times the base pen swath height. In an alternative, if the second group of pens has different colorants than the first group, a twelve pen system of a double swath height within the carriage width of a six pen system.

Figure 1:
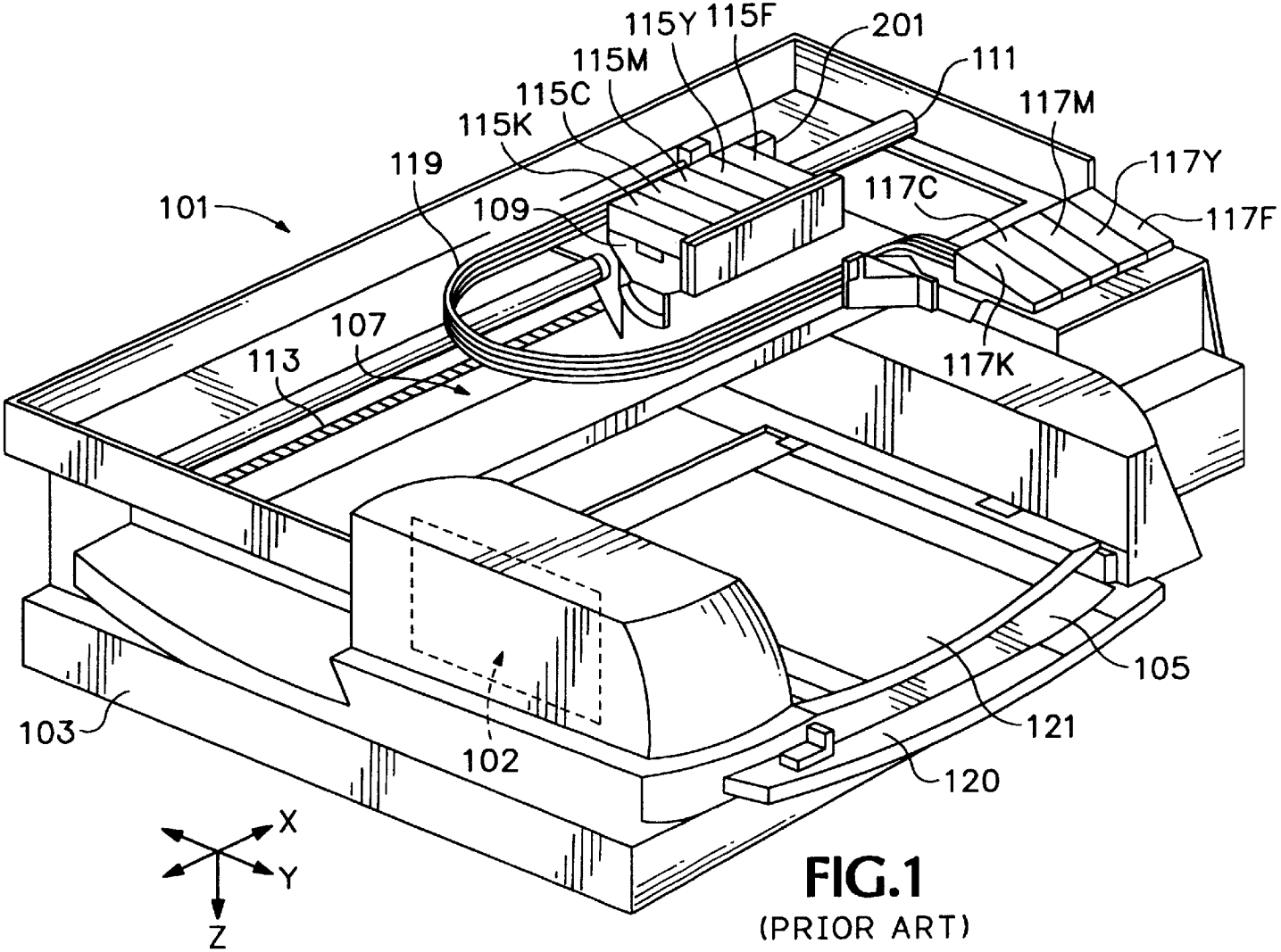
FIG.1 (PRIOR ART)
FIG. 1 (PRIOR ART) is a perspective view drawing of a computer peripheral color ink jet printer.
Figure 4B:
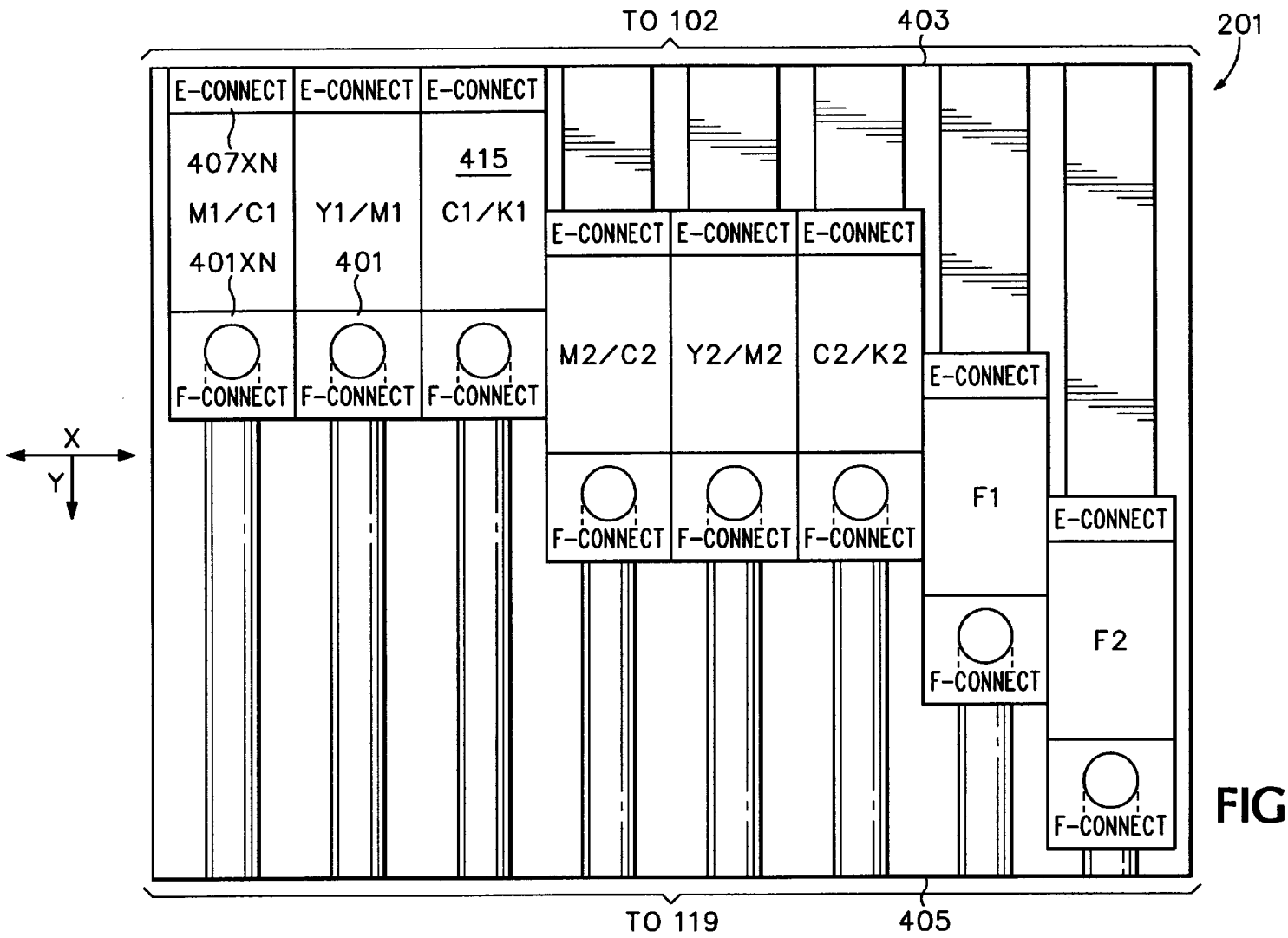

FIG. 4B demonstrates an 8-pen (or multiples thereof by mimicking the layout in a mirrored y-axis arrangement) printing array. Each pen $^{415}{}_{XN}$ is multi-chambered for firing droplets of different inks; the ink feed fluid connects 401 are also segregated for supplying ink appropriately. Note again, how a single electrical interface can be provided along carriage leading edge 403 for connection to the controller 102 (FIG. 1 only) and a single fluidic interface along carriage trailing edge 405 for connection to the ink feed tubes 119 (FIG. 1 only).

Moreover, the carriage layout of FIG. 4B provides further advantages in addition to those listed for FIG. 4A and such as, for example, are set out in Richtsmeier et al., supra, incorporated herein by reference.

Figure 4C:
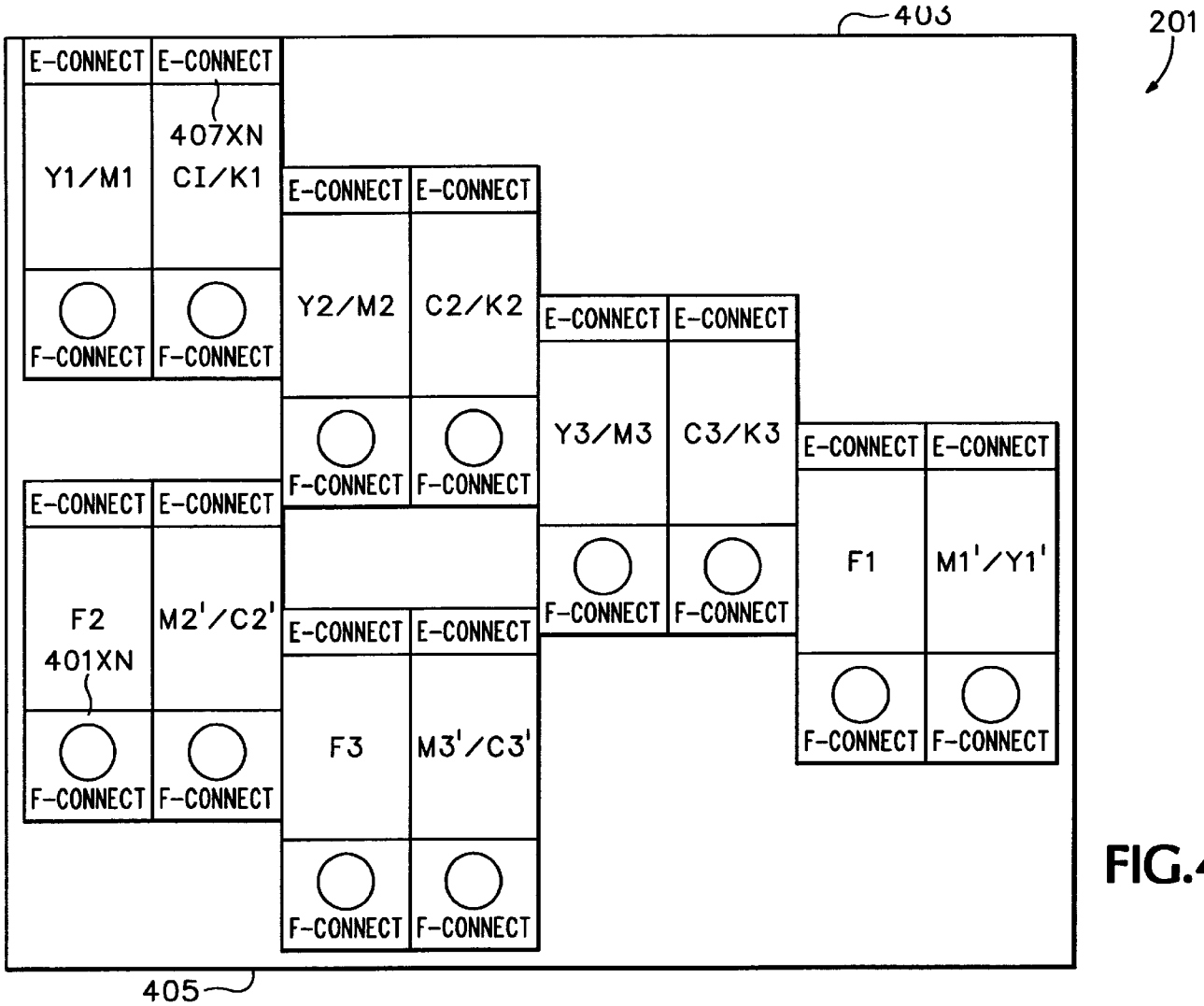

FIG. 4C illustrates a modified twelve pen scanning carriage arrangement which will provide a leading edge 403 commonality for interconnecting the pens electrically and a trailing edge 405 commonality for fluidically interconnecting the pens with ink reservoirs.

Moreover, the carriage layout of FIG. 4C provides further advantages in addition to those listed for FIGS. 4A and 4B in that it allows swath hights of three times the individual pen's base swath height with eight colorants. Again, it allows the gap between first and second groups of pens to be zero, so that if the same ben colors are used in both groups, the cumulative swath height is six times the base swath height. When using multichamber printheads, keeping the electrical connection plane in the same direction eliminates the need to have different ink loading order for mirrored pens.

Figure 4D:
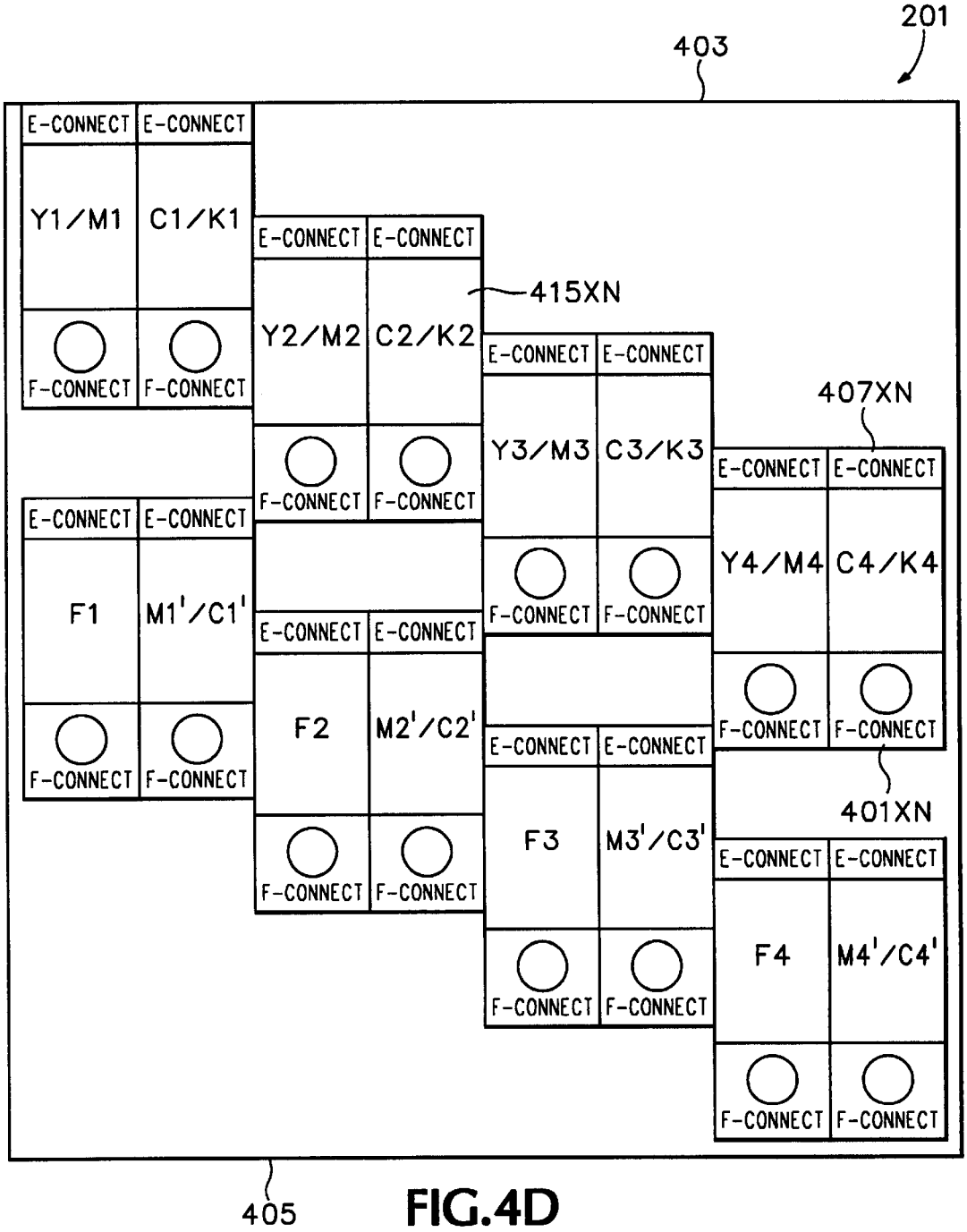

FIG. 4D illustrates an optimized layout for a sixteen pen scanning carriage which will again provide same carriage side interconnect commonalities as in FIG. 4C.

Moreover, the carriage layout of FIG. 4D provides further advantages in addition to those listed for FIGS. 4A and 4B and 4C in that it allows a swath height of four tim3s the base swath height of one pen when using eight colorants and bi-chambered pens. Again, it allows the gap between the first and second group of pens to be zero, so that a four colorant system can repeat this pattern substantially indefinitely, allowing for a swath heights of unlimited size. Commercially, one would envision printing an entire poster print in one pass. Keeping all of the pens in the same orientation eliminates the need for mirrored ink loading.

Note also, that for the specific case of pens with electrical and fluidic interconnects that would constrain the pen packing density if all pens are oriented with the interconnects facing the same direction, the arrangement in accordance with the present invention of the pens with a plane of symmetry between groups of pens containing the interconnects for pens on both sides of the plane allows for a minimized gap, "G," between groups of pens in an arrangement with two groups of pens each having differing colored inks in pens in the two groups. This minimized gap improves throughput—fewer swaths to complete a page that contains all colors—and minimizes product size in the direction of pen offset, y-axis.

In alternative embodiments, when using pens where the electrical interconnect is on one side and the fluidic interconnect is on the other side, and where the space consumed by the fluidic interconnect is significantly larger than the space consumed by the electrical interconnect, an additional size advantage is gained by having all the fluidic interconnections on the perimeter of the carriage and all the electrical interconnections on the plane connecting the two groups of pens.

In summary, the present invention provides an optimized pen arrangement. There are at least two different groups of pens. Within a group, there are multiple pens per color, with an offset between pens of approximately a single swath height, to enable printing a larger swath of that color in a given print sweep across the page. The pens within a group form a contiguous group of nozzles such that the nozzles from the two contributing pens per color act like nozzles from a single printhead. Between groups of printheads, there is also an offset in the y-axis, but this offset may be less than or greater than a swath height in distance. Printheads in different groups are always printing ink of a different color than printheads in the same group. Because of this arrangement, there is no requirement that the nozzles from pens in different groups are able to form a contiguous array of nozzles; thus, the offset is allowed to be greater than the offset between pens within a group. This relaxation in spacing requirement allows pens to be arranged in a matrix where some pens are directly in line with each other in the y-axis. Thus, in the embodiment as shown in FIG. 2, twelve pens fit into the same width "W" that would have otherwise been required for a six pen carriage.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for . . . ."

What is claimed is:

1. An ink-jet scanning carriage printing device for an ink-jet hard copy apparatus having a controller means for providing power and control signals to ink-jet writing instruments, the apparatus being defined by a scanning axis and a print media transport axis perpendicular to the scanning axis, the device comprising:

a scanning carriage; and mounted in the carriage, at least two duplicate sets of ink-jet pen means for firing ink drops onto adjacently positioned print media, the pen means each having a printhead ink drop firing nozzle array of a predetermined height, and each of the sets having at least three color inks such that duplicate pen means of each set form a color subset, and the pen means of each subset are offset linearly in the scanning axis and offset in the transport axis by approximately the nozzle array predetermined height, and each of the pen means having electrical interconnect means for providing power and control signals thereto wherein all electrical interconnect means are connected to the controller from localized substantially adjacent carriage positions.

2. The device as set forth in claim 1, comprising:

each of the pen means having fluid interconnect means for providing ink from off-axis reservoirs thereto wherein all fluid interconnect means are connected to respective off-axis reservoirs from localized substantially adjacent carriage positions.

3. The device as set forth in claim 2, comprising:

all fluid interconnect means are oriented toward to a periphery of the carriage for common bundling of ink feeder tubes from off-axis ink reservoirs to the fluid interconnect means.

4. The device as set forth in claim 2, comprising:

all pen means are mounted in the carriage having respective fluid interconnect means oriented toward a common printed media transport axis direction peripheral side of the carriage for common bundling of ink feeder tubes from off-axis ink reservoirs to the fluid interconnect means.

5. The device as set forth in claim 1, comprising:

all electrical interconnect means are oriented toward to a periphery of the carriage for common bundling of electrical connections from the apparatus controller to the electrical interconnect means.

6. The device as set forth in claim 1, comprising:

all pen means are mounted in the carriage having respective electrical interconnect means oriented toward a common printed media transport axis direction peripheral side of the carriage for common bundling of electrical connections from the apparatus controller to the electrical interconnect means.

7. The device as set forth in claim 2, comprising:

the pens means are mounted in the carriage with a plane of symmetry between groups of pen means containing the fluid interconnect means or electrical interconnect means on both sides of the plane, allowing for a minimized gap, between groups of pen means in an arrangement of the groups in the carriage, with groups of pen means each having like different color inks in pen means between the groups.

8. The device as set forth in claim 7, comprising:

the minimized gap is dimensioned to improve throughput and to minimize carriage size in the scanning axis and print media transport axis.

9. The device as set forth in claim 7, comprising:

wherein the pen means have the electrical interconnect means on one side and the fluidic interconnect means on another side, and where space consumed by the fluidic interconnect means is relatively larger than space consumed by the electrical interconnect means, having all the fluidic interconnect means on a perimeter of the carriage and all the electrical interconnect means on a plane between the groups of pen means.

10. The device as set forth in claim 8, comprising:

the gap is essentially zero within bounds of mechanical design tolerances.

11. A method of rendering ink-jet printing comprising the steps of:

providing a carriage means for scanning ink-jet writing instruments across a print medium;

mounting within the carriage means a plurality of writing instruments in a matrixed array, the array having multiple groups of writing instruments, each group having multiple writing instruments per color and each group having sets of writing instruments offset in a scanning axis and a print medium advance axis such that each set has a writing instrument of each color for the group, the array having each of the multiple groups of writing instruments offset in the print medium advance axis;

scanning the carriage means across the print medium; and while scanning, producing swaths of print simultaneously from redundant color ink writing instruments of the matrixed array such that a swath height capability for each color ink is equal to the sum of individual writing instrument swath height capability for a single writing instrument of the redundant color ink.

12. The method as set forth in claim 11, further comprising the step of:

mounting the ink-jet writing instruments in redundant color groupings wherein a gap between groups is essentially zero within bounds of mechanical design tolerances.

13. A printing unit for an ink-jet printer, comprising:

"N" ink-jet writing means for firing ink drops onto adjacently positioned print media to form dot matrix patterns on the print media, where N is an integer; and carriage means for fixedly supporting the writing means in an array and for scanning the array across the print media in a scanning axis which is perpendicular to a print media transit axis, the array having at least two groups of writing means wherein each group has at least two sets of writing means and the groups are separated in the print media transit axis by a predetermined gap, wherein each set forms group-based subsets of matched color ink writing means such that each subset fires drops of at least one substantially identical ink of the set wherein writing means are positioned in the array such that each subset writing means is mounted in the array linearly from a companion matched color ink writing means of the subset in the scanning axis and offset from a companion matched color ink writing means of the subset in the print media transit axis such that matched color ink writing means of a group are arranged to print a swath height of each the matched color equal to a multiple of an individual writing means printing swath height, wherein one scan across the media and firing drops from matched color ink writing means results in a total swath height of a color equal to the sum of the swath heights of the individual writing means having the matched color ink.

14. The invention as set forth in claim 13, comprising:

a first one of the groups having each set of writing means having one writing means for each primary color ink.

15. The invention as set forth in claim 14, comprising:

a second one of the groups having each set of writing means therein having one writing means for black ink.

16. The invention as set forth in claim 13, comprising:

mounted between the groups, a common interface wall for connecting writing means is mounted such that electrical interconnect surfaces of writing means within the groups are facing each other and optimizing writing means packing density in order to minimize carriage 201 peripheral size dimensions.

17. The invention as set forth in claim 13, comprising:

a gap between two groups of writing means sets is of an arbitrary dimension as long as no writing means in separate groups uses the same ink.

18. The invention as set forth in claim 13, comprising:

each of the writing means having fluid interconnect means for providing ink from off-axis reservoirs thereto wherein all fluid interconnect means are connected to respective off-axis reservoirs from a commonly aligned orientation position of the carriage.

19. The invention as set forth in claim 18, comprising:

all fluid interconnect means are oriented toward to a periphery of the carriage for common bundling of ink feeder tubes from off-axis ink reservoirs to the fluid interconnect means.

20. The invention as set forth in claim 18, comprising:

all writing means are mounted in the carriage having respective fluid interconnect means oriented toward a common is printed media transport axis direction peripheral side of the carriage for common bundling of ink feeder tubes from off-axis ink reservoirs to the fluid interconnect means.

21. The invention as set forth in claim 13, wherein the device is adapted for use with a hard copy apparatus having a controller, the device further comprising:

each of the writing means having electrical interconnect means for coupling each of the writing means to a controller of the apparatus, and all writing means are mounted in the carriage having respective electrical interconnect means oriented toward a common printed media transport axis direction peripheral side of the carriage for common bundling electrical connection from the controller to the electrical interconnect means.

22. The invention as set forth in claim 21, comprising:

all electrical interconnect means are oriented toward to a periphery of the carriage for common bundling of electrical connections from the apparatus controller to the electrical interconnect means.

23. The invention as set forth in claim 21, comprising:

all writing means are mounted in the carriage having respective electrical interconnect means oriented toward toward a common printed media transport axis direction peripheral side of the carriage for common bundling of electrical connections from the apparatus controller to the electrical interconnect means.

24. The invention as set forth in claim 17, comprising:

the gap is dimensioned to improve throughput and to minimize carriage size in the scanning axis and print media transport axis.

25. The invention as set forth in claim 13, comprising:

wherein the writing means have the electrical interconnect means on one side and the fluidic interconnect means on another side, and where space consumed by the fluidic interconnect means is relatively larger than space consumed by the electrical interconnect means, having all the fluidic interconnect means on a perimeter of the carriage and all the electrical interconnect means on a plane between the groups of writing means.

* * * * *